US009629231B1

(12) United States Patent
Douglas et al.

(10) Patent No.: US 9,629,231 B1
(45) Date of Patent: Apr. 18, 2017

(54) ELECTRON BEAM CONTROL FOR BARELY SEPARATED BEAMS

(71) Applicant: JEFFERSON SCIENCE ASSOCIATES, LLC, Newport News, VA (US)

(72) Inventors: David R. Douglas, Yorktown, VA (US); Lucas J. P. Ament, New York, NY (US)

(73) Assignees: JEFFERSON SCIENCE ASSOCIATES, LLC, Newport News, VA (US); ASML NETHERLANDS B.V., Veldhoven (NL)

( * ) Notice: Subject to any disclaimer, the term of this patent is extended or adjusted under 35 U.S.C. 154(b) by 0 days.

(21) Appl. No.: 15/051,782

(22) Filed: Feb. 24, 2016

(51) Int. Cl.
*H05H 7/06* (2006.01)
*H05H 9/00* (2006.01)
*H05H 7/04* (2006.01)

(52) U.S. Cl.
CPC ..... *H05H 7/06* (2013.01); *H05H 7/04* (2013.01); *H05H 9/00* (2013.01)

(58) Field of Classification Search
CPC .. H05H 7/04; H05H 7/06; H05H 7/08; H05H 7/12; H05H 2007/087; H05H 7/02
USPC ..... 315/500–507; 250/396 R, 492.1, 492.3
See application file for complete search history.

(56) References Cited

U.S. PATENT DOCUMENTS

| | | | | |
|---|---|---|---|---|
| 7,382,861 | B2 * | 6/2008 | Madey | H05G 2/00 378/119 |
| 8,093,840 | B1 * | 1/2012 | Douglas | H05H 7/08 315/505 |
| 8,153,990 | B2 * | 4/2012 | Saito | H05H 7/04 250/396 R |
| 8,217,596 | B1 * | 7/2012 | Douglas | H01S 3/0903 250/492.3 |
| 2016/0147161 | A1 * | 5/2016 | Nikipelov | G02B 1/06 355/67 |

* cited by examiner

*Primary Examiner* — Haissa Philogene

(57) ABSTRACT

A method for achieving independent control of multiple beams in close proximity to one another, such as in a multi-pass accelerator where coaxial beams are at different energies, but moving on a common axis, and need to be split into spatially separated beams for efficient recirculation transport. The method for independent control includes placing a magnet arrangement in the path of the barely separated beams with the magnet arrangement including at least two multipole magnets spaced closely together and having a multipole distribution including at least one odd multipole and one even multipole. The magnetic fields are then tuned to cancel out for a first of the barely separated beams to allow independent control of the second beam with common magnets. The magnetic fields may be tuned to cancel out either the dipole component or tuned to cancel out the quadrupole component in order to independently control the separate beams.

3 Claims, 1 Drawing Sheet

ELECTRON BEAM CONTROL FOR BARELY SEPARATED BEAMS

The United States Government may have certain rights to this invention under Management and Operating Contract No. DE-AC05-06OR23177 from the Department of Energy.

FIELD OF THE INVENTION

This invention relates to the transport of beams in an energy recovery linear accelerator and more particularly to providing independent control of two or more barely separated beams in a spreader/recombiner or common transport pipe.

BACKGROUND OF THE INVENTION

If barely split beams have to be transported over several meters, they cannot be independently controlled with magnets, because the magnets act on both beams simultaneously. Bunch quality might be lost as a result, and loss of large amplitude components of beam—"beam halo"—can be aggravated. In addition, control of lattice tuning parameters such as beam envelope functions, phase advances, momentum compactions, and nonlinear aberrations may be compromised.

An example of two or more barely separated electron beams traveling through a common transport pipe includes a spreader/recombiner in which the angles of the split beams are very similar. This occurs in multi-pass systems where coaxial beams at different energies, but moving on a common axis, such as in a linac, need to be split into spatially separated beams for reasons such as recirculation transport. The lowest-energy beam determines the spreader's dipole field strength, and the high-energy beams typically end up very close together.

A dipole with a gradient provides only limited control of the individual split beams. The control is more difficult because control over the magnetic field is more limited. Dipoles have a far more significant impact on the geometry of the beam trajectories. If the field is varied over a wide range, the trajectories change a lot and this can create other interferences.

Accordingly, what is needed is a method for achieving independent control of multiple beams in close proximity to one another, such as in a spreader/recombiner. Independent control over the multiple beams would be of value in the design, construction, and operation of multipass SRF linac based accelerators, such as CEBAF, free electron lasers (FEL), or other energy recovery linacs (ERL).

OBJECT OF THE INVENTION

A first object of the invention is to provide, in a single transport line containing multiple beams of different energy, independent control of individual beams.

A second object of the invention is to provide, in a common transport line with common magnets, independent control of individual, closely spaced beams with the same or different energies.

Another object of the invention is to enable focusing and steering of two or more beams in very close proximity.

A further object of the invention is to provide a means of separately controlling multiple passes of beams using a single transport line.

A further object of the invention is to provide a means for correcting chromatic aberrations at the place where they occur, such as immediately after the dipole of a spreader/recombiner, using a spatially compact configuration of magnets acting independently on multiple beams. This advantage is not present in an alternative solution of the problem: a combined function dipole magnet. The combined function dipole magnet is disadvantageous as it requires intervening focusing and it will occupy more space.

These and other objects and advantages of the present invention will be better understood by reading the following description along with reference to the drawing.

SUMMARY OF THE INVENTION

The present invention is a method for achieving independent control of multiple beams in close proximity to one another, such as in a multi-pass accelerator where coaxial beams are at different energies, but moving on a common axis, and need to be split into spatially separated beams for efficient recirculation transport. The method for independent control includes placing a magnet arrangement in the path of the barely separated beams with the magnet arrangement including at least two multipole magnets spaced closely together and having a multipole distribution including at least one odd multipole and one even multipole. The magnetic fields are then tuned to cancel out for a first of the barely separated beams to allow independent control of the second beam with common magnets. The magnetic fields may be tuned to cancel out either the dipole component or tuned to cancel out the quadrupole component in order to independently control the separate beams.

DETAILED DESCRIPTION

Figure 1:
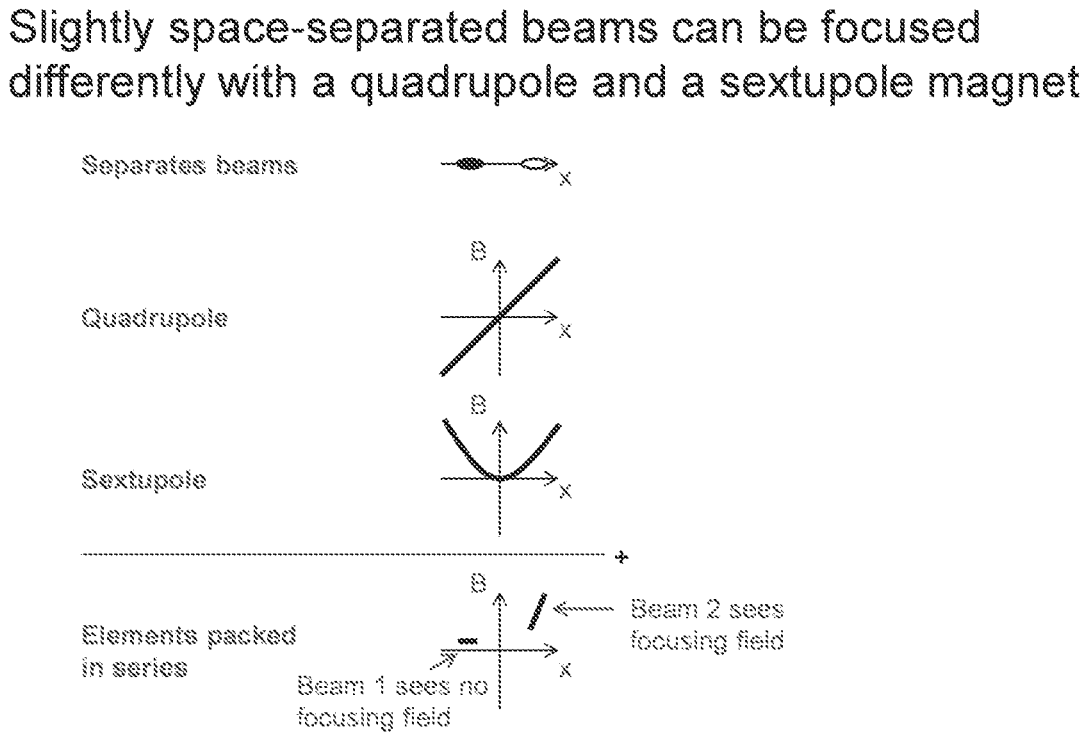
FIG. 1 is a graph depicting a method for achieving independent control of slightly space-separated beams with a quadrupole and a sextupole magnet.

The invention is a method to independently control multiple, barely separated beams in a spreader/recombiner by directing the beams through at least two multipole magnets spaced closely together or through a magnet with two or more multipoles. The multipole distribution needs to contain at least one odd and one even multipole, so that the magnetic fields can be tuned to cancel out for one of the beams. This allows independent control of the other beam(s) with common magnets.

The canceling of the magnetic fields can be done by two methods, including 1) canceling out the dipole component, which will in general leave some defocusing effect, but doesn't steer the beam in another direction, and 2) canceling out the quadrupole component, which method will generally result in a remaining dipole field, but there is no defocusing.

With reference to FIG. 1, there is shown a method for independently controlling multiple, barely separated beams in a spreader/recombiner by having them go through at least two multipole magnets spaced closely together or through a magnet with two or more multipoles. The multipole distribution needs to contain at least one odd and one even multipole, so that the magnetic fields can be tuned to cancel out for one of the beams. This allows independent control of the other beam(s) with common magnets. Slightly space-separated beams can be focused with a quadrupole and a sextupole magnet. Beam 1 sees no focusing field whereas beam 2 sees the focusing field.

According to the present invention there is proposed a method of independently controlling multiple, barely separated beams in a common transport pipe or spreader/recombiner, including the steps of:

1) providing a magnet arrangement including at least two multipole magnets spaced closely together and having a multipole distribution including at least one odd multipole and one even multipole;
2) placing at least two closely spaced multipole magnets in the path of the barely separated beams; and
3) tuning the magnetic fields to cancel out for a first of the barely separated beams to allow independent control of the second beam with common magnets.

Tuning the magnetic fields may include:

1) tuning the magnetic fields to cancel out the dipole component, or
2) tuning the magnetic fields to cancel out the quadrupole component.

Although the description above contains many specific descriptions, materials, and dimensions, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A method of independently controlling multiple, barely separated beams in a common transport pipe, comprising:

providing a magnet arrangement including at least two multipole magnets spaced closely together and having a multipole distribution including at least one odd multipole and one even multipole;

placing the closely spaced multipole magnets in the path of the barely separated beams; and tuning the magnetic fields to cancel out a first of the barely separated beams to enable independent control of the second beam with common magnets.

2. The method of claim 1 further comprising tuning the magnetic fields to cancel out the dipole component.

3. The method of claim 1 further comprising tuning the magnetic fields to cancel out the quadrupole component.

* * * * *